United States Patent [19]

Darnall

[11] 4,433,609

[45] Feb. 28, 1984

[54] SUSPENDED LOOP AMMUNITION MAGAZINE

[75] Inventor: Larry N. Darnall, Santa Clara, Calif.

[73] Assignee: FMC Corporation, Chicago, Ill.

[21] Appl. No.: 293,802

[22] Filed: Aug. 17, 1981

[51] Int. Cl.[3] ..... F41D 10/14

[52] U.S. Cl. ..... 89/34

[58] Field of Search ..... 89/34, 33 R, 33 B, 33 BA, 89/33 BB, 33 BC

[56] References Cited

U.S. PATENT DOCUMENTS

| | | | |
|---|---|---|---|
| 1,790,867 | 2/1931 | Jervey | 89/33 BC |
| 1,800,595 | 4/1931 | Browning | 89/33 BB |
| 1,901,868 | 3/1933 | Dabrasky | 89/33 R |
| 2,360,035 | 10/1944 | Birkigt | 42/50 |
| 2,452,545 | 11/1948 | Broga | 89/34 |
| 2,573,774 | 11/1961 | Sandberg | 89/34 |
| 2,710,561 | 6/1955 | Dowd | 89/34 |
| 2,811,084 | 10/1957 | Cook et al. | 89/34 |
| 2,874,615 | 2/1959 | Kravik | 89/34 |
| 2,889,751 | 6/1959 | Bilek | 89/34 |

FOREIGN PATENT DOCUMENTS

| | | | |
|---|---|---|---|
| 575122 | 8/1939 | United Kingdom | 89/33 BB |

OTHER PUBLICATIONS

*Vulcan Air Defense System,* GEK 50205-1, Jan. 1976, General Electric Company, pp. 4–114, 4–116, 4–118.

*Primary Examiner*—Donald G. Kelly

*Attorney, Agent, or Firm*—A. J. Moore; H. M. Stanley; R. B. Megley

[57] ABSTRACT

An ammunition magazine stowing belted rounds for rapid fire guns has generally horizontal, laterally spaced side rails for slidably supporting a file of uppermost rounds from which depend loops of rounds. In order to restrain forward sliding motion of an uppermost forward round into a gap at the forward ends of the round supporting rails, a resiliently mounted restrainer roller is mounted above the forward round while it is suspended on the rails. The roller prevents the forward round from sliding off the rails in case the magazine box is tilted forwardly or jarred, thereby preventing entanglement, hand up or jamming as a string of rounds is fed upwardly to the gun breech.

4 Claims, 28 Drawing Figures

FIG_11
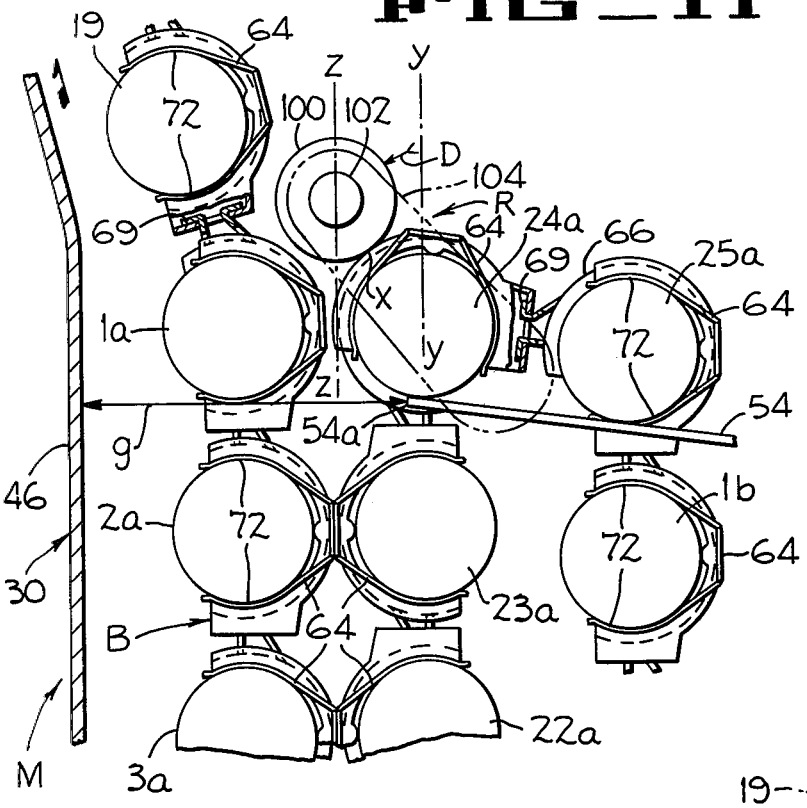
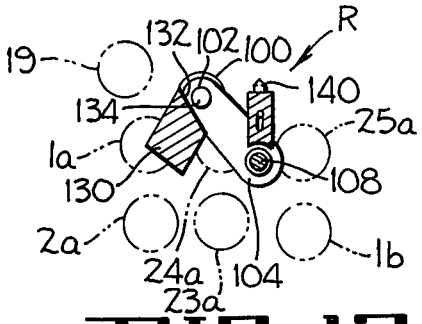
FIG_12
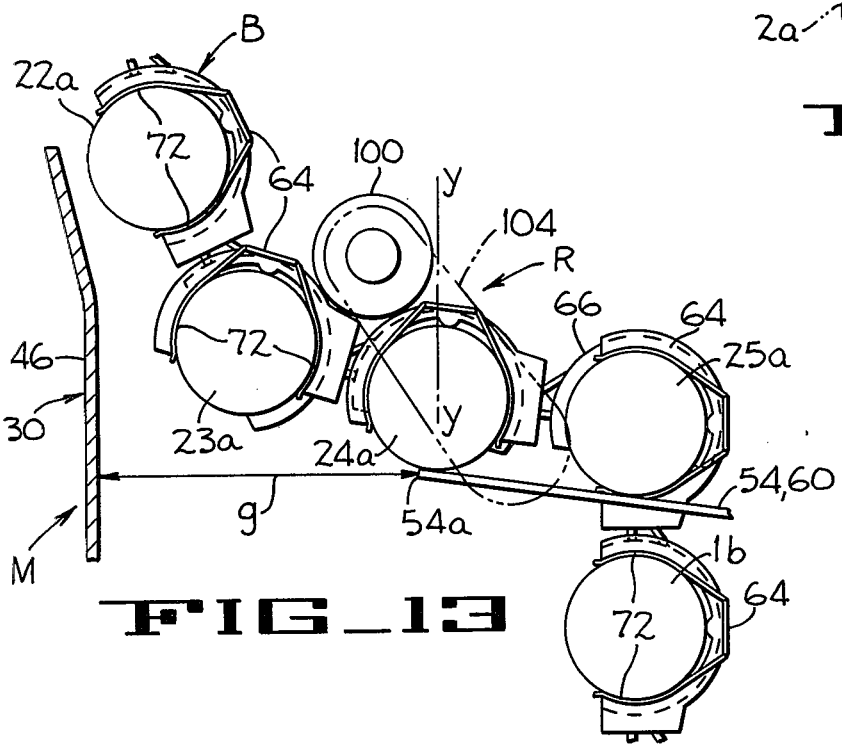
FIG_13
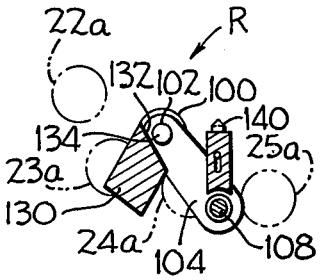
FIG_14

FIG_18
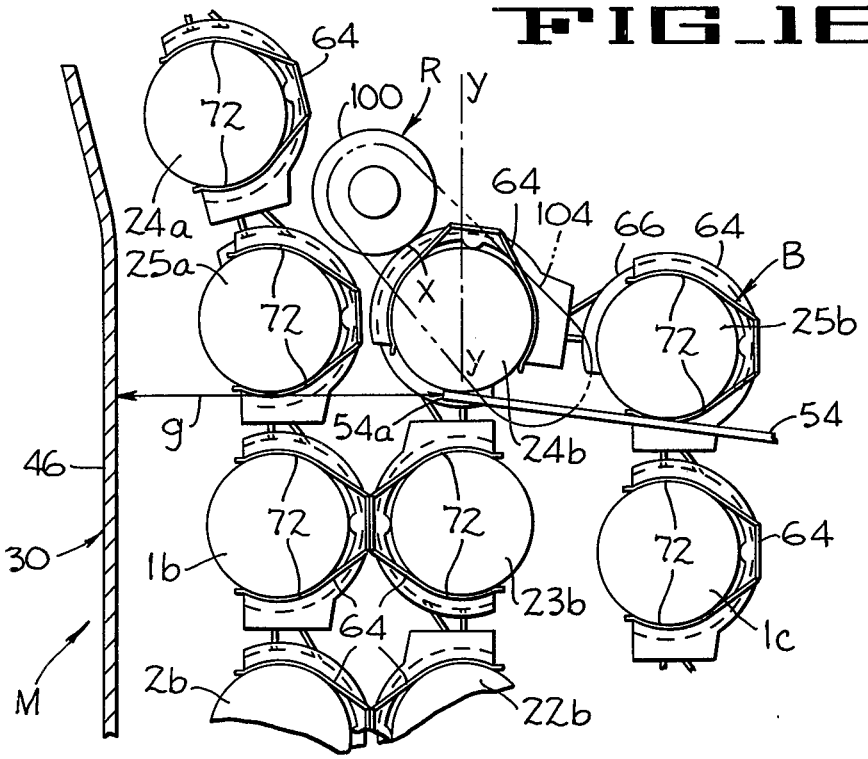
FIG_20
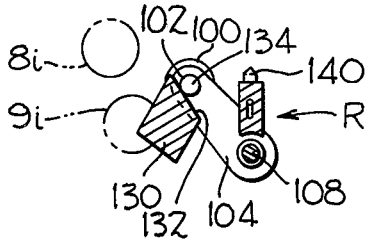
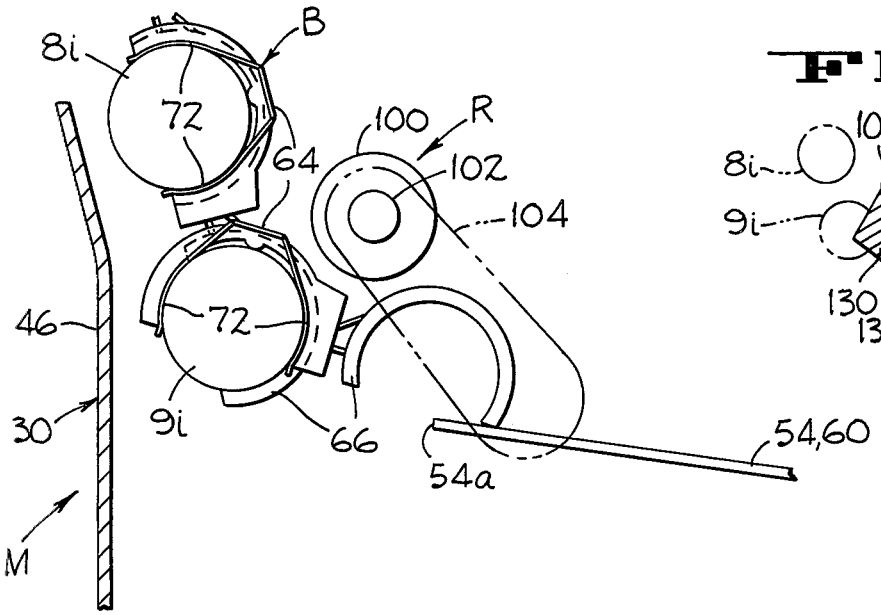
FIG_19

FIG_21
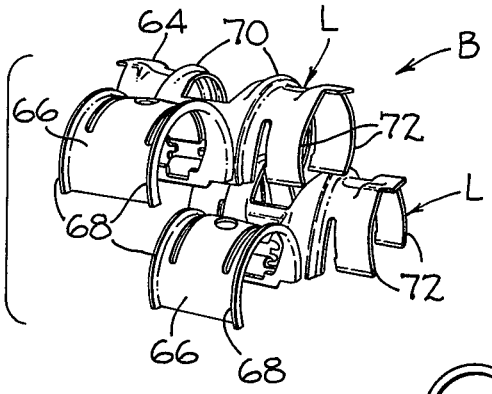
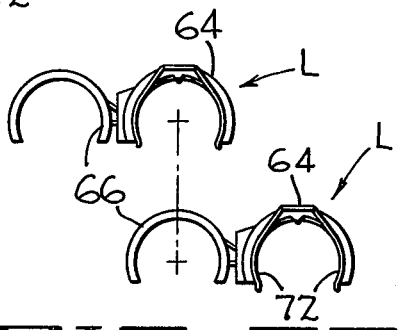
FIG_22
FIG_23
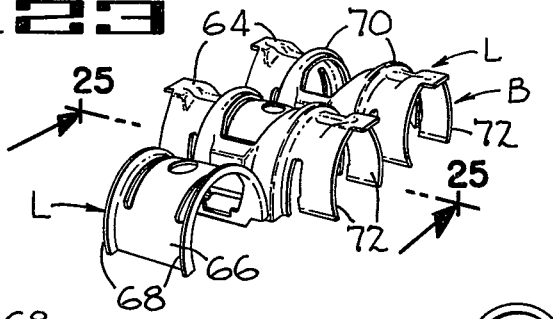
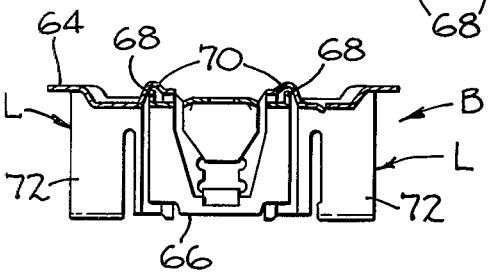
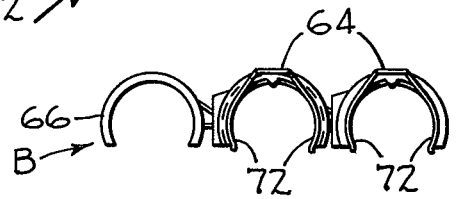
FIG_24
FIG_25
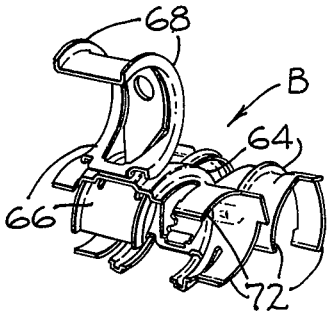
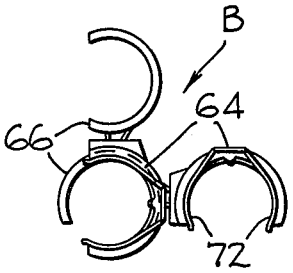
FIG_26
FIG_27

SUSPENDED LOOP AMMUNITION MAGAZINE

BACKGROUND OF THE INVENTION

1. Field of the Invention

This invention relates to ammunition magazines and more particularly to suspended stowage magazines for belts of interconnected rounds that feed rapid fire guns.

Suspended loop stowage magazines which stow gravity suspended loops of rounds interconnected by belts or articulated clips are known. The magazine of the present invention is of the type wherein the upper rounds of each suspended loop are slidably supported on laterally spaced, generally horizontal side rails, with the belts disposed between the rails. This sliding suspension presents entanglement or jamming problems when the guns are fitted to the vehicles which must traverse hilly country or rough terrain that jostles the rounds of the magazine and urges the loops to slide along their rails. This action can be aggravated by gun recoil.

2. Description of the Prior Art

Dabrasky U.S. Pat. No. 1,901,868, Mar. 21, 1933 discloses a storage box for horizontal folds or loops of ammunition wherein the loops rest upon one another along their lengths. The storage box is inverted to deposit the loops horizontally in a magazine chamber at the gun.

Dowd U.S. Pat. No. 2,710,561, June 15, 1955 discloses an aircraft ammunition box having partitions with upper pivoted extensions which suspend loops of a cartridge belt. Each extension carries a spring mounted retractable pawl which releasably supports a depending loop of cartridges.

Cook et al U.S. Pat. No. 2,811,084, Oct. 29, 1957 discloses a suspended stowage ammunition magazine wherein the rounds are connected by articulated spring metal clips which form a belt. The magazine sidewalls mount opposed, vertical loop separator ribs. The upper ends of all ribs (except those nearest the gun) mount sickle shaped arm guides that have an extent along the feed path of the belt and temporarily suspend a preceding loop until the feed tension on the belt has taken the weight of the succeeding loop. This avoids creation of a slack bight at the crest of rounds between successive loops.

Birkigt U.S. Pat. No. 2,360,035, Oct. 10, 1944 discloses a firearm magazine wherein the cartridges are urged down in outlet passage by a magazine spring. A spring loaded rocking member has a retractable nose portion and projects through an aperture formed on one wall of the passage for maintaining the axial orientation of cartridges.

Bilek U.S. Pat. No. 2,889,751, June 9, 1959 discloses an ammunition magazine having angled partition members that separate loops of belted ammunition. The ammunition is drawn from the magazine discharge port between a lower, fixed pivot roller and fixed upper guide plates.

SUMMARY OF THE INVENTION

The magazine of the present invention includes horizontal rails for slidably supporting the upper rounds of suspended loops of rounds or cartridges in an ammunition magazine box. As rounds are withdrawn from a forward or leading string of rounds that feed the gun directly, an uppermost round that suspends an immediately subsequent string of rounds can slide along its supporting rails toward the front or feeding end of the magazine. During operation of the vehicle mounting the gun, if the magazine is tilted forwardly enough to overcome the coefficient of friction between the uppermost rounds and the rails, or if the magazine is both tilted forwardly and jarred, jamming or hang-up of the forward suspended ammunition string can occur.

For example, the forward ends of the rails stop short of the front wall of the magazine in order to provide a gap for accommodating feeding of a forward ascending string or reach of rounds directly to the gun. An uppermost round is also supported by the rails and this round supports a depending string of rounds just behind the gap. If the aforesaid uppermost rail supported round slides forwardly it will drop into the gap, which also drops the entire string of rounds supported by the aforesaid upper round into empty space below the gap. This action carries the dropped string of rounds against any ascending reach or string of rounds that is being fed directly to the gun. Such a condition could cause interference with cartridge feeding because of belt entanglement or round hang-up, including trapping of a round beneath the forward ends of the rails.

In accordance with the present invention, the aforesaid undesirable round shifting, round dropping and re-formation of the cartridge loops or strings in a horizontal suspension rail-type magazine is prevented. The aforesaid round dropping action is prevented by the provision of cartridge retaining means for resiliently restraining the uppermost forward round from sliding forward off the ends of the rails and into the gap between the rails and ascending string of rounds being fed directly to the gun. In the preferred embodiment of the invention, the aforesaid resilient restraint of the uppermost forward round supported on the rails is engaged by a resiliently mounted, transversely extending restraining device, preferably formed as a roller rotatably mounted on a resiliently loaded arm.

The preferred arm construction is one wherein the arm is pivotally supported on a wall of the magazine box and is spring loaded to urge the round restraining device or roller rearwardly. The roller resiliently clamps the leading rail-suspended round against the rails and prevents its sliding into the gap ahead of it.

When all of an initially loaded, depending forward string of rounds being fed directly to gun have been pulled up through the feeding throat of the magazine, the lowermost round of that string is pulled up against the resiliently mounted restrainer. This cams or lifts the restrainer to permit the withdrawal of a top round from the rails. This round suspends a succeeding string of rounds from the rails. Continued feeding action pulls the ascending string against the resiliently mounted restrainer, cams the restrainer rearwardly and permits the top round to be slid off the front ends of the supporting rails. When this occurs, the top round and the string of rounds suspended thereby, drop into the vacant gap ahead of the rails. As soon as this action takes place, the restraining device is resiliently urged against the succeeding uppermost round and it now prevents that round from sliding off the ends of the rails. Thus the restraining device continues to preclude entanglement, hang-up, jamming or the like as the uppermost rounds are successively pulled off the front ends of the rails in response to gun firing.

Preferably, a stop is provided for limiting the round clamping motion of the retainer and a latch device is also provided for holding the restrainer in a round-release position during a magazine loading operation.

BRIEF DESCRIPTION OF THE DRAWINGS

FIG. 11 is an enlarged fragmentary diagram illustrating an initial condition of the ammunition in the magazine.

FIG. 12 is a simplified diagram of a reduced size showing the position of the restrainer arm in FIG. 11.

FIG. 13 is a diagram like that of FIG. 12 showing the condition of the ammunition after some of the ammunition has been withdrawn into the gun.

FIG. 14 is a reduced size schematic diagram showing the position of the restrainer arm in FIG. 13.

FIG. 18 is a diagram like that of FIG. 16 wherein an additional round has been fed to the gun.

FIG. 19 is a diagram showing the last round of the string of rounds having been fed past the restraining mechanism.

FIG. 20 is a diagram like that of FIG. 15 showing the restrainer mechanism against a stop in the condition of FIG. 19.

FIG. 21 is a reduced size perspective illustrating two ammunition clip links before assembly with a round or cartridge of ammunition.

FIG. 22 is a side view of the assembly of FIG. 21.

FIG. 23 is a diagrammatic perspective of the ammunition belt like that of FIG. 21 but with the two links assembled. The cartridges have been omitted from these diagrams for clarity.

FIG. 24 is a side view of the assembly of FIG. 23.

FIG. 25 is a section through the link assembly taken on line 25—25 of FIG. 23.

FIG. 26 is a diagram like that of FIG. 23 with a foremost link pivoted upwardly to show the pivoting action.

FIG. 27 is a side view of the link assembly of FIG. 26.

DETAILED DESCRIPTION OF PREFERRED EMBODIMENT

Ammunition Box

Figure 1:
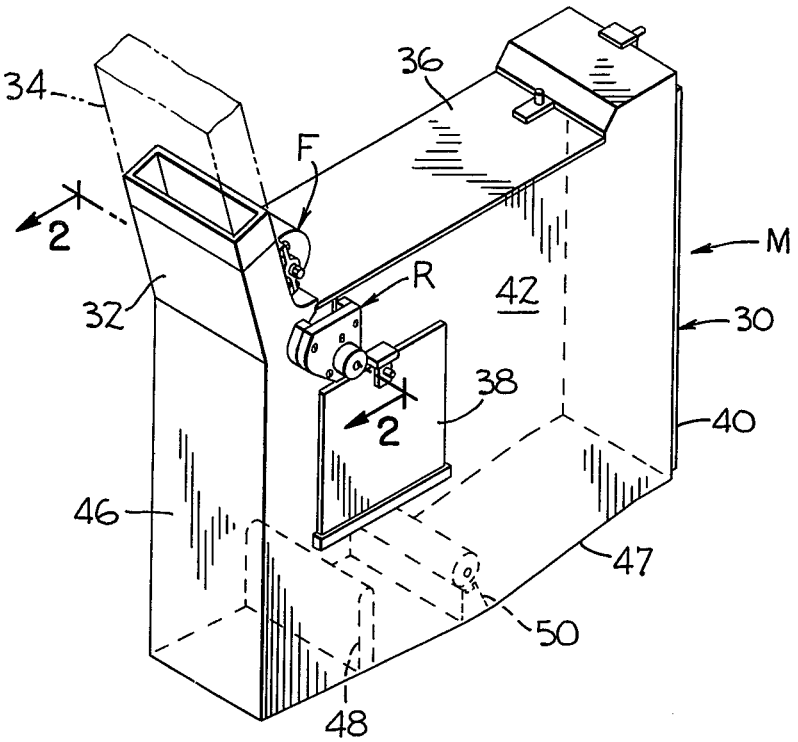
FIG. 1 is a diagrammatic perspective of a magazine embodying the present invention.

FIG. 1 illustrates in simplified form some major elements of an ammunition magazine M embodying the present invention. The magazine M is formed as a multiround stowage box 30 having a forward round delivery throat 32 that connects to a feeder tube 34 for directing belted rounds (not shown in FIG. 1) to the breech of a gun (not shown). The box has removable top, side and rear doors 36, 38 and 40, respectively, that can be removed for loading ammunition into the box. The box has side walls 42 and 44 (see FIG. 2), a front wall 46 and a bottom wall 47.

Also seen in FIG. 1 is a structure for mounting a restrainer assembly R of the present invention on the side wall 42 of the box and structure for mounting an ammunition forwarder F mounted on the rear wall of the throat 32.

Projecting up a relatively short distance from the bottom wall 47 of the box (FIG. 5) is a front loop separator partition 48 and a rear loop separator roller partition 50. These short partitions help to eliminate entanglement of the suspended loops of ammunition.

Figure 2:
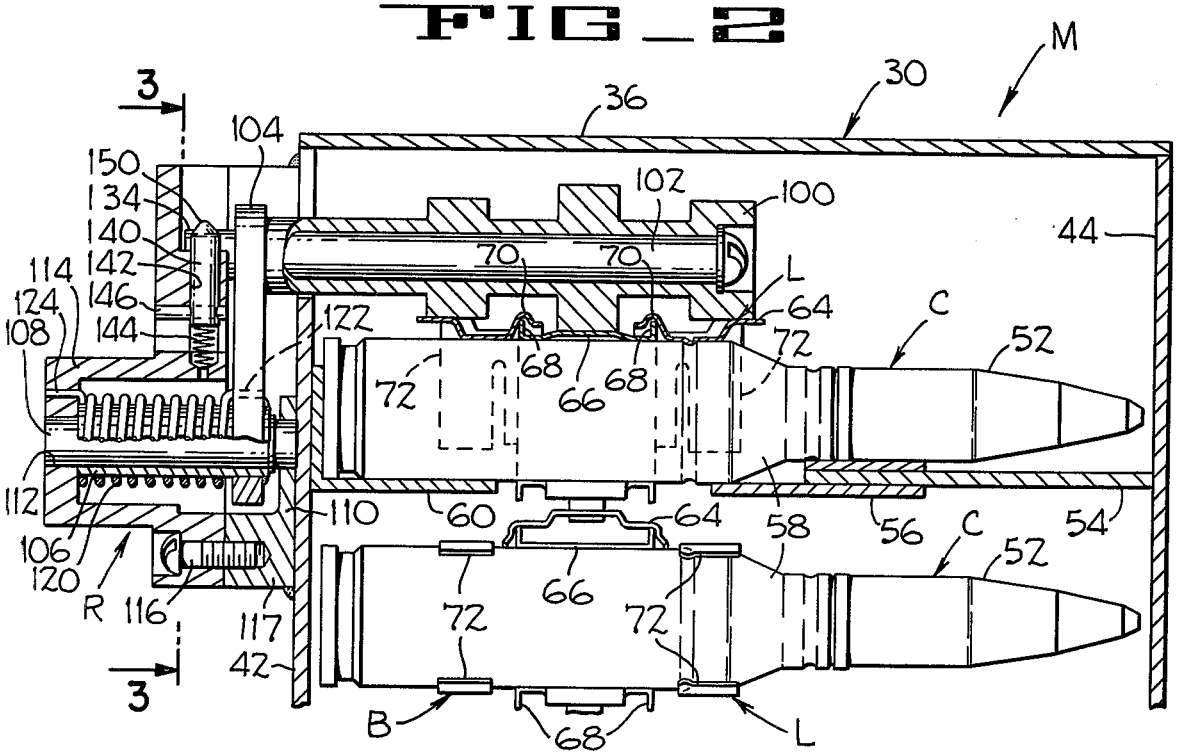
FIG. 2 is a fragmentary enlarged section taken on line 2—2 of FIG. 1.

FIG. 2 shows how an upper round or cartridge C supports a string or loop of belted ammunition. The uppermost round C of a loop is slidably supported on spaced, laterally projecting, generally horizontally disposed rails. Looking from the rear of box 30, the projectile portion 52 of the upper cartridge C is slidably supported on a right hand rail 54 which projects laterally inwardly from the right side wall 44 of the box 30. An extension 56 of the right rail 54 supports the right hand end of the cartridge case 58. The left hand end of the cartridge case 58 is slidably mounted on a left hand rail 60 which projects inwardly from the left side wall 42 of the box 30. As seen in the diagrams of FIGS. 5–9, the right and left rails 54 and 60 extend horizontally along an upper portion of side wall 44 of the box and have front ends 54*a* which stop short of the front wall 46 of the box. This leaves a gap "g" which freely accommodates one depending string of cartridges C but which does not freely accommodate two depending strings.

Cartridge Belt

Figure 9:
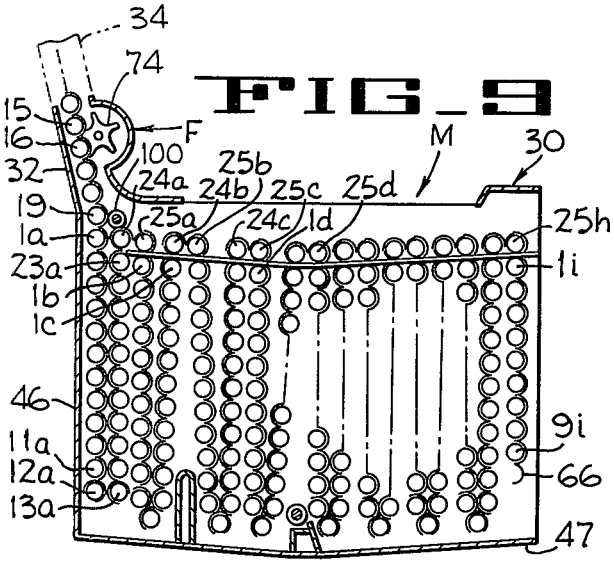

The rounds of cartridges C are joined by an articulated metal cartridge belt B to form a linked or articulated string of ammunition, most of which is initially stowed in the magazine box 30 (FIG. 9). The details of the belt B are not critical to the present invention and a belt of known construction is shown in FIGS. 2, 11 and 21–27.

The belt B is made up of a series of dual links L, each link having a double U configuration. Each link L has a narrow, half round, female U-shaped section 64 connected to a wider, half round, male U-shaped section 66. The link sections are connected by a bent tab structure 69 (FIG. 11). The narrow male section 66 of each link is externally ribbed at 68 which ribs are rotatably received in complementary grooves 70 (FIG. 25) of ribs formed in the associated female section 64 of a link L.

The female link sections 64 are wider than the male section 66 because the ends of each female section 64 form spring clips 72 (FIGS. 21–26) which resiliently grip an associated cartridge case 58. The clips 72 are shown in dotted lines behind a cartridge case in FIG. 2. When a cartridge case is clipped into an assembled pair of male and female link sections 64 and 66, the cartridge case holds those sections together yet the sections 64 and 66 can pivot relative to one another about the axis of the cartridge case which joins the two sections, because the narrow male link section 66 is not clipped to the cartridge case.

As seen in FIG. 2, the cartridge belt B formed by the articulated links L can pass between the inner longitudinal edges of the round support rails 54 and 60. As seen in FIG. 9, a front string of rounds is supported by a forwarder device F to be described presently. The front string forms a loop with a rearward string which is supported at the front end of the rails by an uppermost cartridge 24a (also see FIG. 11).

Cartridge Numbering System

Before continuing with the description of the present invention an explanation of a cartridge numbering convention adopted for purposes of description will be provided. All unfired cartridges are alike physically and have been given the general designations C. However, by means of the cartridge belt B a series of cartridges C can be linked together to form an articulated string of cartridges. Because of space limitations in FIGS. 5–10, the general reference character C has been omitted and successive cartridges in a linked string have been given sequential reference numbers starting with number 1. For example, strings or loops of cartridges 1–19, 1a–25a, 1b–25b, etc., are shown in FIGS. 5–10 and 17. The series of numerical designations mentioned above are selected arbitrarily and merely represent a loading sequence found suitable for the ammunition box 30 being described in detail.

The Forwarder

As seen in FIGS. 1 and 4–9, the forwarder F is provided at the rear of round delivery throat 32. The forwarder has three functions. First, it supports the uppermost round of a forward depending string of belted ammunition as seen in FIG. 9. Second, it can freewheel and accommodate the advance or lifting of the forward string of rounds by the breech mechanism (not shown) of the gun. Third, the forwarder can be manually rotated by a crewman during an initial step of the loading operation for advancing the leading round of a leading string of rounds up through the tube 34 (FIG. 9) and into the breech loading mechanism (not shown) at the gun.

Figure 4:
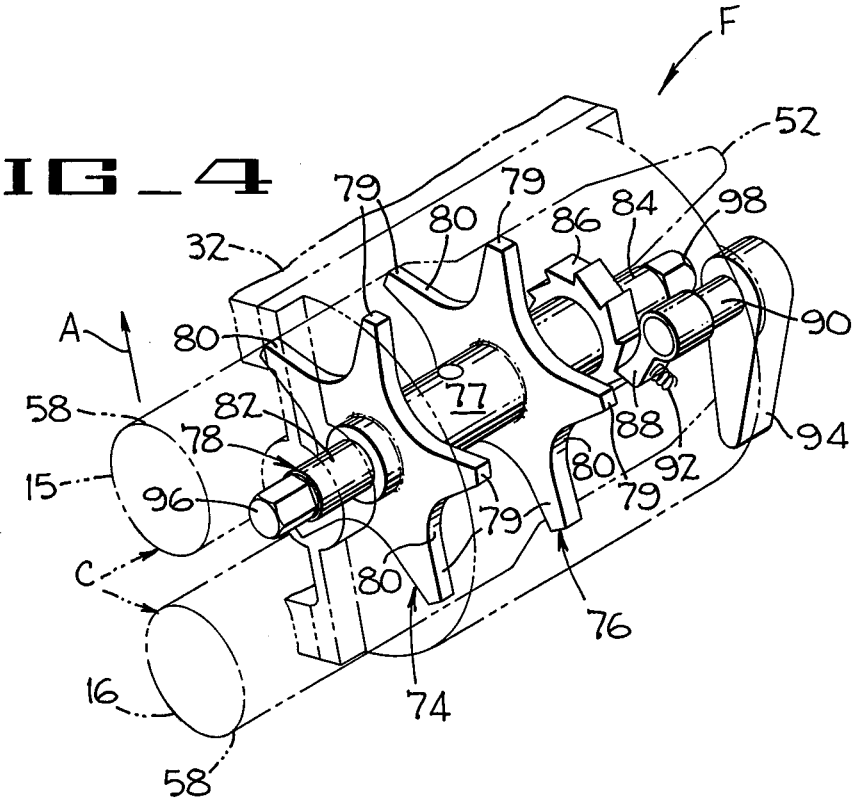
FIG. 4 is a diagrammatic perspective of the forwarder mechanism.

The construction of one form of forwarder F is shown in the diagrammatic perspective of FIG. 4, it being understood that the mechanical details of the forwarder are not critical to the present invention. The forwarder has laterally spaced star wheels 74 and 76 mounted on a sleeve 77 pinned to a common shaft 78. Each star wheel has five lobes 79. The star wheel lobes 79 form cartridge receiving and supporting pockets 80 which cooperate with the front wall of throat 32 of the box 30 to support a round (number 15 in FIG. 9) and suspend a string of rounds depending therefrom.

The star wheel shaft 78 has end bearings 82, 84 which rotatably support the shaft in the side walls 42, 44 of the ammunition box at the throat 32. The star wheels 74, 76 and the shaft 78 are rotated by the cartridges in response to an advance or lifting action exerted on the string of cartridges by the gun breech loading action and illustrated by the arrow A in FIG. 4. However, after the gun loading action ceases, the star wheels again support a round C in the position formerly occupied by round number 15 in FIGS. 4 and 9. This free wheeling action is preferably provided by a simple ratchet wheel and pawl assembly. A toothed ratchet wheel 86 is secured to the star wheel sleeve 77 and cooperates with a pawl 88 having a stub shaft 90 rotatably supported by the ammunition box side wall 44. A spring 92 urges pawl 88 against the ratchet wheel 86.

In the embodiment shown, since star wheels 74, 76 have five lobes, the ratchet wheel 86 is provided with ten teeth so that the star wheel lobes can be stepped through the desired angles but are prevented from retrograde revolution after each of one-tenth turn. This ensures a step-by-step free wheeling action of the star wheels, followed by symmetrically disposed latched positions of the lobes 79.

The ratchet wheel 86 can be manually released by retracting the pawl 88. This is accomplished by means of a manually operable lever 94 on the outer end of the pawl shaft 90.

During an initial phase of the loading action, to be described presently, star wheels 74, 76 are manually rotated to feed cartridges C in the first string (Nos. 1–19 in the example given) in the direction of arrow A (FIG. 4) and up through throat 32 and tube 34 leading to the gun breech. The aforesaid manual rotation of the star wheel shaft 78 is facilitated by hexagonal end or nut portions 96 and 98 formed on opposite ends of the star wheel shaft. During initial loading, a crewman fits a ratchet socket wrench to either hex 96 or 98 and selectively turns the star wheel shaft 78 to cause the star wheels to successively advance the leading cartridge (No. 1 in the example given) of the first string of cartridges (Nos. 1–19) into the gun breech.

The Cartridge Restrainer Assembly

Figure 15:
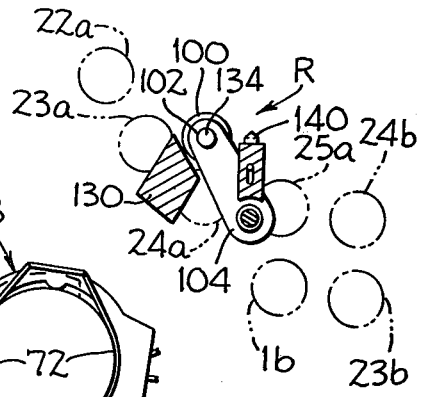
FIG. 15 is a diagram like that of FIG. 14 showing the position of the restraining roller arm.

As mentioned, the function of the cartridge restrainer assembly R of the present invention is that of restraining rounds supported near the forward ends of the rails 54, 60 and adjacent to gap "g" (FIGS. 9 and 15). The restrainer prevents the forward round on the rails from sliding forwardly along the rails and falling off the rails into the gap "g". This restraint is important when the ammunition box is tilted forwardly, is jarred or is both jarred and tilted forwardly during travel or maneuvering of the vehicle mounting the ammunition box. The effects of gun recoil can aggravate undesired sliding action of the rounds.

In the preferred embodiment of the invention, the aforesaid cartridge restraining action is provided by a resiliently mounted roller which clamps the uppermost forward cartridge disposed at the forward ends of the rails and just behind the gap "g". The forward cartridge is clamped against the rails and is resiliently but releasably restrained from forward shaking motion along the rails.

Figure 3:
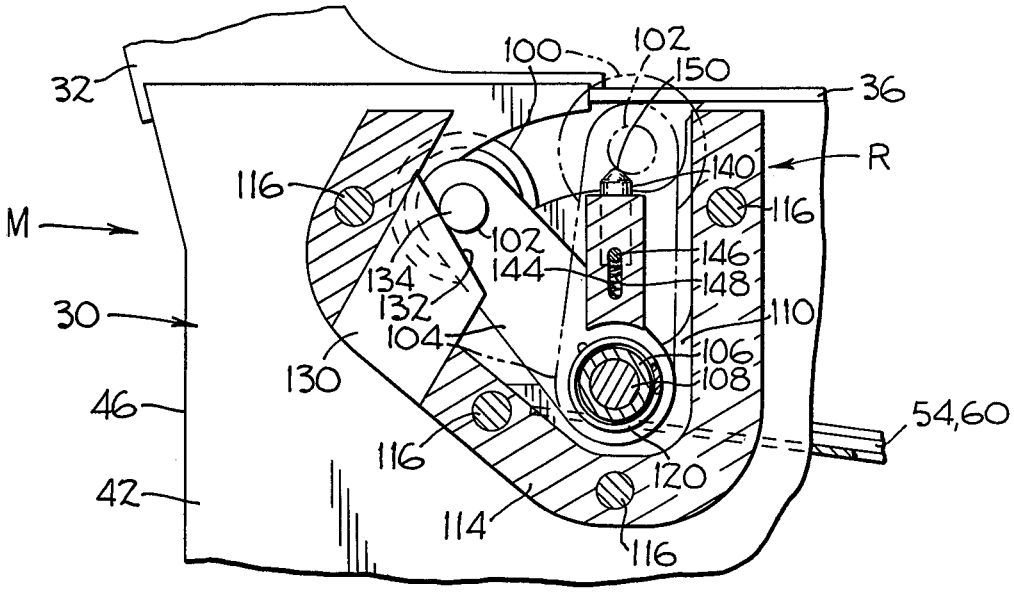
FIG. 3 is a section taken on line 3—3 of FIG. 2.

Details of the restrainer assembly appear principally in FIGS. 2 and 3. The cartridge engaging and restraining element is a stepped or contoured roller 100 rotatably mounted on a roller shaft 102. The shaft 102 projects laterally from the upper end of a spring loaded arm 104, the lower end of the arm being secured to the inner end of a sleeve 106. The sleeve 106 is rotatably mounted on a short shaft or pin 108, the inner end of which fits into a socket in a housing flange 110 (FIG. 2). The outer end of pin 108 fits into an aperture 112 formed in a cover plate 114. The cover plate 114 is secured by screws 116 to a housing member 117 welded to the side wall 42 of the box 30.

The roller arm 104 is resiliently urged in a counterclockwise direction, as viewed in FIGS. 3 and 5–16, by a helical spring 120 that surrounds the sleeve 106. The inner end 122 of spring 120 projects into a spring socket formed in the roller arm 104 and the outer end 124 of the spring projects into a socket formed in the cover plate 114.

Restrainer Roller Geometry

The geometry of the round clamping position of the roller 100, a cartridge, the rails and other parts is illustrated in FIG. 11. This figure shows an upper round number 24*a* supported at the front ends of rails 54, 60 just behind the gap "g". A forward string of rounds 19, 1*a*–3*a* are shown hanging down in the front portion of gap "g". This string is supported by the star wheels 74, 76 of the forwarder F (FIGS. 4 and 9).

A vertical plane y—y passing through the axis of round 24*a* (FIG. 11) is disposed rearwardly of a vertical plane z—z passing through the axis of the restrainer roller 100. The spring 120 urges arm 104 and attached roller 100 in the direction of arrow D so that the lower periphery of roller 100 engages the cartridge link portion for cartridge 24*a* at a point "x". Point "x" is to the left of (forward of) the vertical plane y—y passing through the axis of cartridge number 24*a*.

As a consequence of the geometry of the assembly just described, the restrainer roller 100 exerts a force at point "x" which clamps the round number 24*a* rearwardly against the rails 54 and 60 (rail 60 not appearing in FIG. 11). Also, the vertical clearance space between the contact point "x" and the rails is less than the height of round 24*a* and its link portion 64, as measured in the vertical plane y—y. In other words, the round belt height exceeds the clearance space between the roller 100 and the rails. This action releasably restrains round number 24*a* from sliding forwardly on rails 54 and 60 and into the gap "g" under the force of gravity or as a result of jarring forces.

Additional Restrainer Assembly Structure

As seen in FIG. 3, a stop 130 is secured in the cover plate 114. The stop is positioned so that a rearwardly facing stop face 132 can be engaged by an outer end portion 134 of the roller shaft 102. The stop engagement action illustrated in FIG. 3 only takes place when the ammunition box 30 is empty or after the last round has been fed clear of the restrainer roller 100 (FIGS. 19 and 20).

A latch system is provided whereby the restrainer roller 100 can be temporarily held in a retracted or disabled position for clearing rounds as they are being loaded into the magazine M. The roller disabling action is effected by a spring loaded vertical latch pin 140 slidably mounted in a socket 142 formed in the cover 114. A coil spring 144 urges the latch pin 140 upwardly, motion being limited by a transverse pin 146 riding in a slot 148 formed in the cover 114. The outer end 150 of the latch pin 140 is conically bevelled to provide a self-camming latch action as the restrainer roller 100 is grasped and pulled rearwardly against spring 120, preparatory for the loading operation. The roller 100 can be manually released by pushing it forwardly over the end 150 of the latch pin.

Magazine Loading Procedure

Although the magazine loading procedure is not critical to the present invention, an understanding of the procedure renders apparent several advantages of the generally horizontal cartridge supporting rail structure, which structure also presents the very problem solved by the round restrainer apparatus of the present invention. Certain operations that are performed to provide a fully loaded magazine (about 228 rounds in the example given) are illustrated in the simplified schematic diagrams of FIGS. 5–9. At the outset, it should be understood that in some cases the cartridges or rounds of ammunition being loaded into the magazine are relatively large, so that complete belted string of rounds would be quite heavy and awkward to manipulate.

As will be seen, the rails 54, 60 (both seen in FIG. 2) have several basic functions. First, they support the uppermost rounds of depending loops or strings of rounds. This maximizes the number of rounds that can be loaded into or stowed in the magazine without entanglement.

Second, the rails are generally horizontal and slidingly support the aforesaid uppermost rounds. The sliding support accommodates dragging or pulling of uppermost rounds along the rails in response to the round feeding action at the front of the magazine directly into the gun breech.

Third, the rails serve as a round support or suspension structure during the magazine loading operation. The trailing half link of a previously loaded or preceding string or loop of rounds can be snapped over the leading round of a new or succeeding string of rounds while a previously loaded round is supported by the rails. This snap coupling action of the links of rounds provides a continuous string of rounds in the magazine.

Referring to FIGS. 5–8, the restrainer roller 100 has been manually retracted and latched, as shown in dotted lines in FIG. 3, before loading the magazine M. In the magazine and gun system under description it so happens that 19 rounds are disposed between the gun breech (not shown) and the front side of the restrainer roller 100. Also, five rounds (numbers 15–19) are suspended between the upper pockets 80 of the star wheels 74, 76 in the forwarder F and the front side of the restrainer roller 100. These predetermined numbers dictate the first loading steps shown in FIG. 5.

Figure 5:
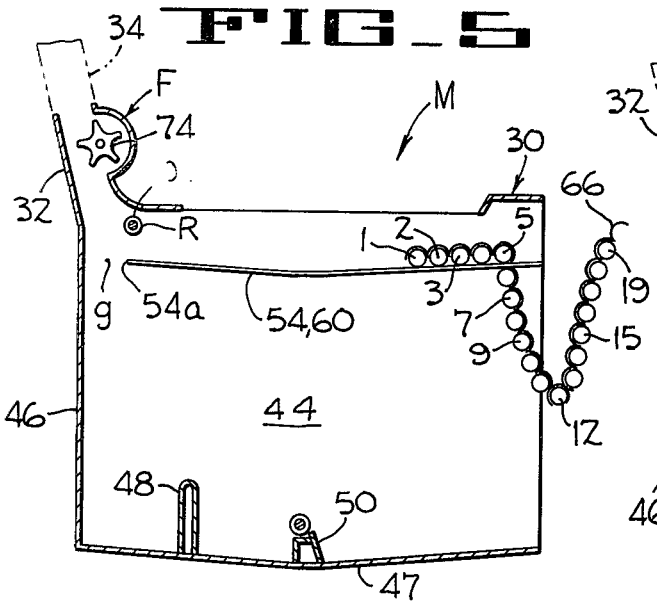
FIG. 5 is a simplified diagram showing an initial stage of the magazine loading procedure.

Before loading, all magazine doors 36, 38 and 40 (FIG. 1) are opened to accommodate cartridge string manipulation during the loading operation. A string of 19 rounds is made up externally of the magazine by successive snapping clip fingers 72 of link portion 64 over a round that is embraced by a succeeding link portion 66. As seen in FIG. 5, after the first string of 19 rounds has been made up, rounds 1–5 are slid along the rails 54, 60 by reaching through the rear and the top openings of the magazines. At round 19, an empty link portion 66 projects rearwardly, ready to receive the first round of the succeeding string.

Figure 6:
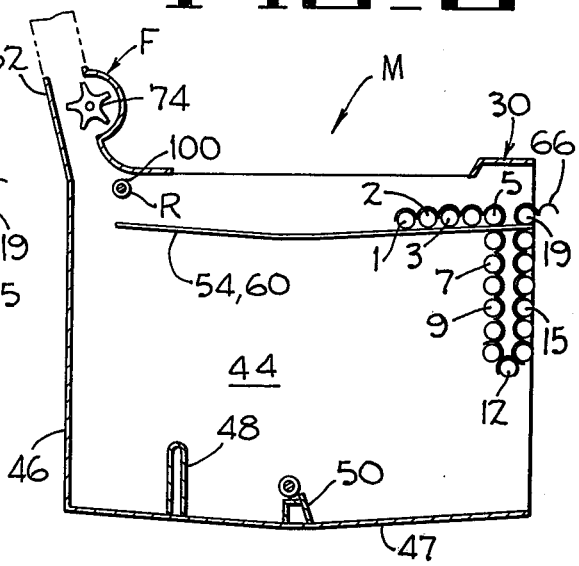
FIGS. 6–9 are similar diagrams showing successive stages of the loading procedure.

As seen in FIG. 6, the last round 19 of the first string is slid onto the rails thereby providing a short loop of depending rounds 6–18.

Figure 7:
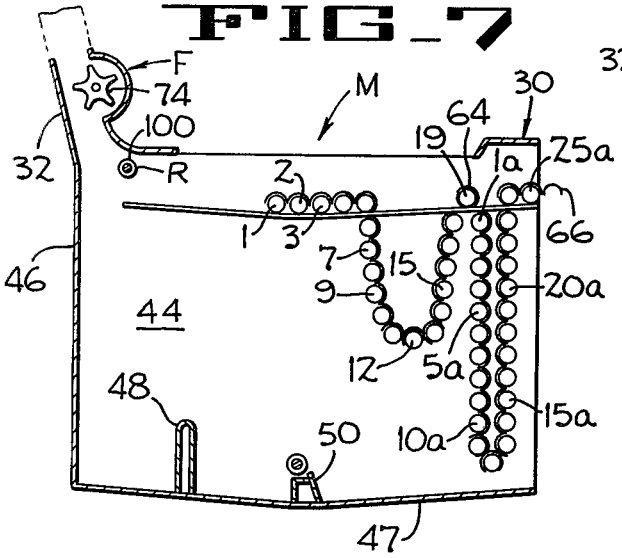

Referring to FIG. 7, the trailing link portion 66 is embraced by a female link portion and link 64 is clipped to round 1*a* of a new string of 25 rounds, namely, rounds 1*a*–25*a*. Thus round 1*a* pivotally gains the link portion 64 of the new string to the empty link portion 66 of the previous string. Round 1*a* is positioned below the rails 54, 60 after being linked to round 19. Round 1*a* and those ahead of it are then slid forwardly along the rails.

Figure 8:
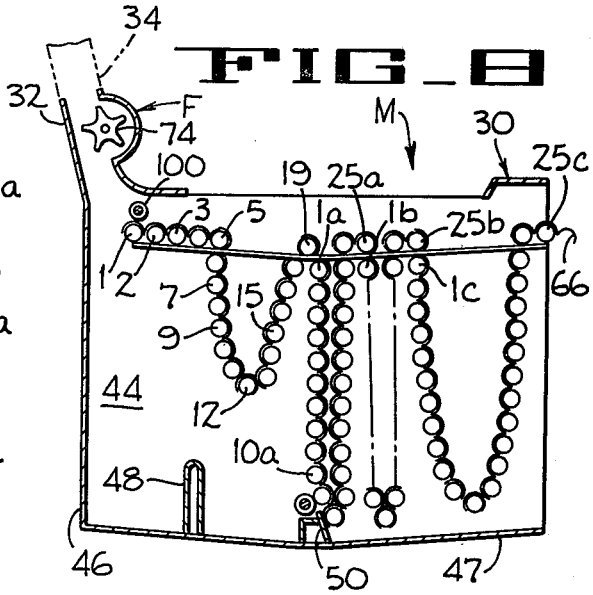

FIG. 8 illustrates the connection of round 1*b* (of a string of 25 preassembled rounds 1*b*–25*b*) to round 25*a*, this connection is made in the same manner whereby round 1*a* was connected to the link portion 66 that trailed round 19. After assembly of rounds 1*b*–25*b* they form a continuation of rounds 1*a*–25*a*. Round 1*c* of rounds 1*c*–25*c* is now assembled with a trailing link portion 66 at round 25b. Round 25b, along with those ahead of it are then slid forwardly along the rails 54, 60, and it will be noted that loops of rounds depend from the uppermost rounds 24a, 25a and 24b, 25b which uppermost rounds are supported on the rails.

Still referring to FIG. 8, the trailing link portion 66 at round 25c of the string of rounds 1c–25c is free to receive a round 1d and an associated link portion 64 of a string of rounds 1d–25d (not shown in FIG. 8). Also in FIG. 8, the leading rounds 1–5 are shown in position to be lifted (through the open front door of the box) into the forwarder star wheels.

FIG. 9 illustrates a fully loaded magazine. The leading rounds 1–5 (FIG. 8) have been lifted into and advanced through the star wheels 74, 76 of the forwarder F and have been pushed up through the tube 34 to the gun breech (not shown). This action is carried out by applying a ratchet wrench to the shaft of the forwarder F, as previously described. Further ratchet advance of the star wheels has lifted round 15 into a position where it is supported by the star wheels. Rounds 16–19 and 1a–12a depend from round 15 along the front wall 46 of the box 30. Rounds 23a–13a depend from round 24a but the latter round is supported on the rails 54, 60 at the gap "g". Thus, a loop of 23 rounds hangs down beneath the roller 100 and the rails 54, 60 at the front of the box. Also, succeeding loops of 23 rounds hang down from uppermost pairs of rounds 24b and 25b, 24c and 25c, etc., which uppermost pairs are supported along the rails. The final string of rounds 1i–9i is suspended from the rear round 25h, the latter round also being supported on the rails.

After having thus loaded the ammunition box 30, the restrainer roller 100 is gripped by reaching through the top door and shifted to clear the latch pin 140 (FIG. 3), whereupon the roller springs to its forward, round restraining position. The various doors for the magazine box are now fitted into place on their respective walls and the loaded magazine M is now ready for action.

Possible Jam Condition

Figure 10:
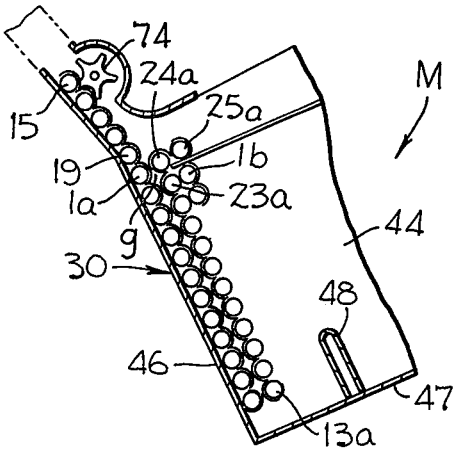
FIG. 10 is a diagram illustrating the action when the magazine is tilted forwardly.

FIG. 10 illustrates a possible jam condition that could take place if the restrainer roller 100 and associated mechanism were not present or if the roller were left in its latched, retracted position with the magazine loaded or partially loaded with ammunition.

One advantage of the action of the retainer roller 100 can be visualized by comparing FIG. 9, where the roller is in action, with FIG. 10 where no roller is provided and wherein the magazine box 10 has been inclined, urging ammunition supported on the rails to slide forwardly along the rails.

In FIG. 9, a round 15 in throat 32 is suspended on the star wheels of the forwarded mechanism F and the front string of rounds, 15–19 and 1a–12a is suspended by the round 15. This string forms a front half of a loop of rounds, the rear half of the loop being suspended from the rails by the uppermost round 24a. The rear half of the loop is made up of rounds 13a–23a. Since the uppermost round 24a is prevented from sliding off of the front ends of the rails 54, 60 and into the gap "g", it provides no interference with the forward string of rounds as the latter is progressively pulled up through the gap "g" and onto the gun.

In FIG. 10 the condition of FIG. 9 are repeated except that the restrainer roller 100 is assumed not to be present or out of action. Also, in FIG. 10 a forward tilt or jar of the ammunition box 10 has caused the uppermost round 24a to slide forwardly off the front ends of the rails 54, 60 and to rest against the round 1a of the front depending string of rounds. The round 23a just below the uppermost round 24a is also resting against rounds on the depending string of rounds and is trapped beneath the rails 54, 60. Now when the front string of rounds is withdrawn for feeding into the gun breech, such withdrawal can be interfered with by the depending string of rounds 23a–13a. If round 23a is caught beneath the rails, it can interleave with and thus interfere with upward feeding of the front string of rounds 15–19 and 1a–12a. Entanglement, jamming or interference with the feeding operation can thus take place in the absence of the action of the restrainer 100 of the present invention.

Detailed Description of Operation

FIGS. 11–20 show several steps in the action of the restrainer 100 of the present invention and several of these figures are drawn in enlarged form for clarity of illustration.

FIG. 11 illustrates in fragmentary enlarged form the conditions previously described in connection with FIG. 9. The round 15 (not shown in FIG. 11) is suspended by the star wheels of the forwarder F (FIG. 9) and only the round 19 of the string of rounds 15–19 previously described in connection with FIG. 9 appears in FIG. 11. Rounds 1a–3a also appear in FIG. 11 but below round 3a the front string of rounds is not shown. Similarly, the uppermost round 24a suspended on the rails 54, 60 appears in FIG. 11 along with rounds 23a and 22a suspended from round 24a. In addition, the next rearward uppermost round 25a is shown suspended on the rails 54, 60 with this round suspending the first round 1b of a succeeding loop of rounds.

In FIG. 11, the restrainer roller 100 is being urged to the left or counterclockwise in the direction of the arrow D and the lower periphery of the roller 100 engages the upper periphery of the link 64 that embraces the round 24a. Drawn in for reference in FIG. 11 is a vertical plane y—y passing through the axis of the uppermost suspended round 24a. Also drawn in FIG. 11 is a plane z—z passing through the axis of the restrainer roller 100. It is noted that the axis z—z of the restrainer roller is to the left or forward of the axis y—y of the uppermost suspended round 24a and that the point of contact x between the roller 100 and the link 64 embracing round 24a is forward of the vertical plane y—y. Thus, the point x is somewhat lower than the uppermost periphery of the link 64, as measured in the vertical plane y—y passing through the axis of the uppermost round 24a, which round is embraced by the link 64 in question.

The arm 104 which mounts the restrainer roller 100 appears in broken lines in FIG. 11. The geometry of the parts illustrated in FIG. 11 is such that the point of contact x between the restrainer roller 100 and the link 64 embracing the uppermost round 24a must be somewhat lower than the highest part of the link 64 as measured in the vertical plane y—y. Thus, the roller 100 not only urges the round 24a downwardly against the suspending rails 54, 60 and clamps around 24a in the position illustrated but provides a restricted throat that resiliently restrains round 24a from forward motion. This action prevents the round 24a from sliding forward off the ends of the rail 54, 60 and then to the gap "g" under the force of gravity or under jarring in recoil forces. Under these conditions, the front string of rounds of which rounds 19 and 1a–3a can slide up freely through the gap "g" as the front string of rounds is fed upwardly to the gun breech and this free feeding of the forward string of rounds is not interfered with by the round 24a or by any of the rounds depending therefrom, such as 23a, and 22a appearing in FIG. 11. Although the ammunition box 30 is shown in a horizontal position in FIG. 11, the aforesaid resilient restraining and clamping action of the roller 100 against the uppermost suspended round 24a will hold the round 24a in the position shown in FIG. 11 even if the ammunition box is tilted forwardly, jarred, or both.

FIG. 12 is a small diagrammatic view of the restrainer assembly R under the condition shown in FIG. 11. It will be noted in FIG. 12 that the projection 134 of the shaft 102 that mounts the restrainer roller 100 has not engaged the opposed face of the stop member 130 in FIG. 12. Thus, the pivoting action exerted on the arm 104 the mounts the restrainer roller 100 by the coil spring 120 (FIG. 2) is taken up by the engagement of the roller with the uppermost round 24a, as previously described in connection with FIG. 11.

Insofar as the action of the restrainer roller is concerned, the conditions in FIG. 13 resemble those of FIG. 11. However, in the conditions of FIG. 13 the gun has fired enough rounds to completely withdraw the front loop of rounds right up to the uppermost round 24a that rests on the rails 54, 60. Thus, in FIG. 13 round 23a, instead of hanging down from the uppermost suspended round 24a, has now been pulled up against the restrainer roller 100 by the loading action at the gun. Now the feeding of rounds will lift the rounds 22a, 23a illustrated in FIG. 13 but such action has not yet exerted any force upon the spring loaded restrainer roller 100. Thus, the roller 100 still clamps the uppermost suspended round 24a against the rails 54, 60 at the front end 54a and resiliently retains the round on those rails. As seen in the diagram of FIG. 14, the extension 134 of the shaft 102 that supports the restrainer roller 100 and still clear of the opposed face 132 of the stop 130.

Figure 14A:
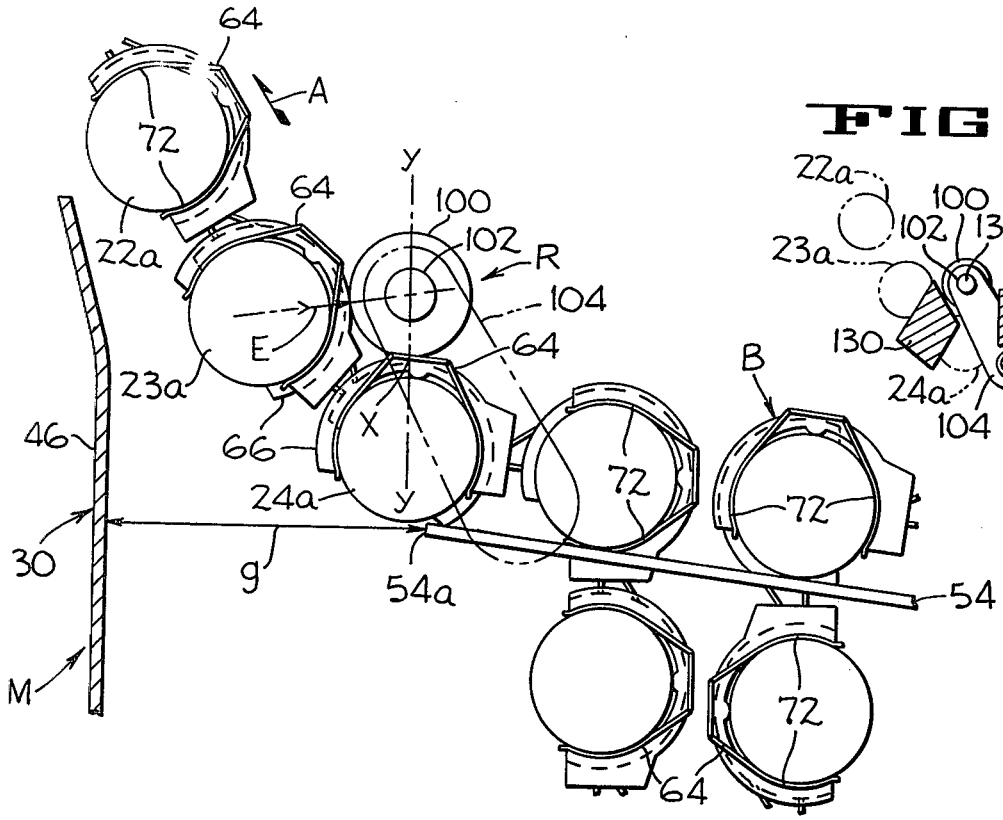
FIG. 14A is a diagram like that of FIG. 13 except that a round of ammunition has cammed the restraining arm rearwardly in response to feeding action to the gun.

In FIG. 14A, the round feeding action at the breech of the gun has lifted the rounds 22a, 23a as illustrated in the direction of the arrow A. This causes the round 23a to pivot about the axis of the uppermost round 24a suspended on the rails 54, 60. Round 23a now exerts a camming action, illustrated by the arrow E, against the restrainer roller 100, camming the roller rearwardly or to the right, as illustrated in FIG. 14A. Under these conditions, if there is any contact at point x between the roller 100 and the link 64 that embraces the round 24a, the point of contact x takes place along the vertical plane y—y through the axis of the uppermost round 24a. Contact point x is now at its highest point in plane y—y and additional camming action in the direction of arrow E will cause the retainer roller 100 to clear round 24a. Under these conditions, the restrainer roller 100 does not exert any restraining action on the uppermost round 24a and the latter round is readily pulled clear of the rails 54, 60 which previously supported the round. The rounds 22a, 23a, and 24a can now be lifted upwardly and fed toward the gun as illustrated by the arrow A.

The conditions of FIG. 14A also appear in FIG. 15 and it will be noted that the extension 134 of the shaft 102 for the roller 100 is still clear of the stop 130.

Figure 16:
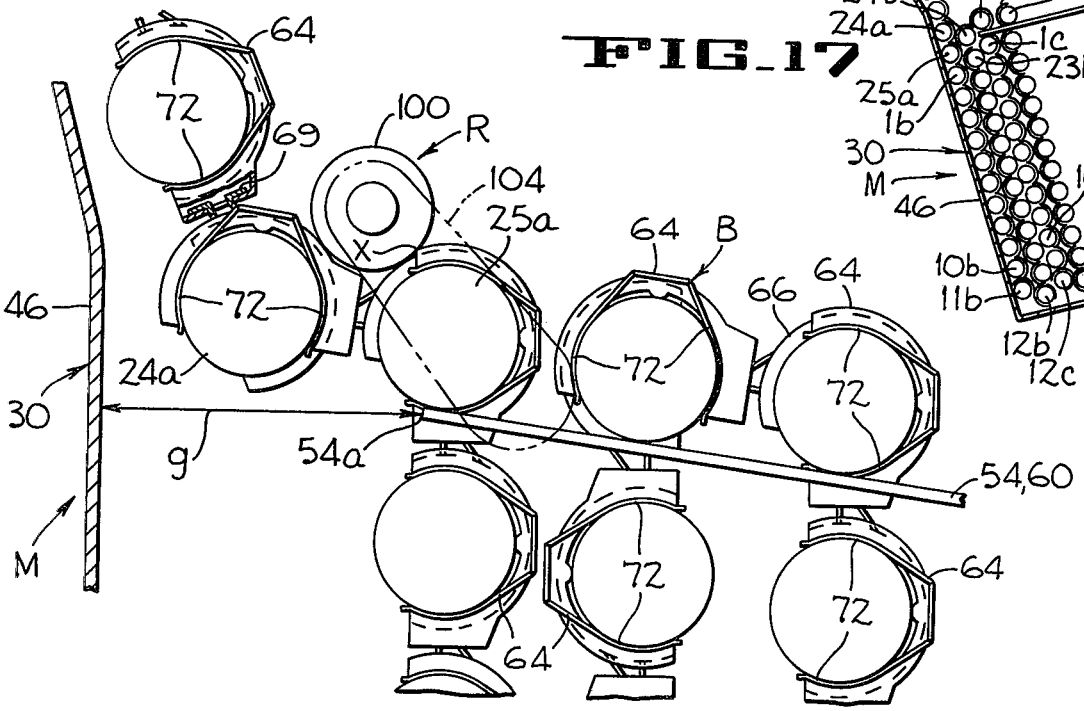
FIG. 16 is a diagram like that of FIG. 14A after one more round has been fed to the gun.

FIG. 16 illustrates a condition that occurs immediately after that illustrated in FIG. 14A. In FIG. 16, the round 24a has been pulled off the front ends 54a of the rails 54, 60, is now clear of the rails and is just above the gap "g". Under these conditions, the spring 120 (FIG. 2) urges the arm 104 counterclockwise, or to the left as viewed in FIG. 16 and has brought the roller 100 down so that the point of engagement "x" between the roller 100 and the link embracing the round 25a is again to the left of or ahead of the vertical plane y—y passing through the axis of the suspended round 25a. The forward, uppermost suspended round 25a is now clamped or restrained against the rails 54, 60 and hence cannot slide forwardly into the gap "g" under the force of gravity or the like.

Figure 17:
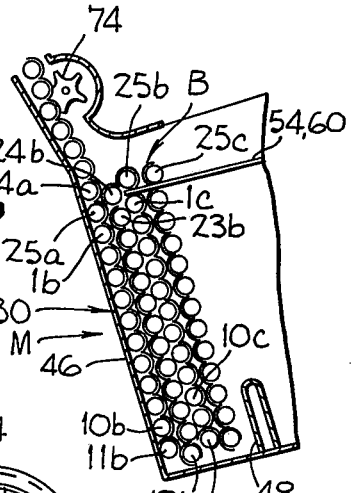
FIG. 17 is a diagram like that of FIG. 10 showing the action that would occur when the magazine is tilted and the restrainer of the present invention were not present.

The small diagram of FIG. 17 illustrates conditions corresponding to those shown in FIG. 16, but under conditions wherein the restraining roller 100 is not present or is latched in its disabled condition.

In FIG. 17 it is assumed that the ammunition box 10 has been tilted forwardly, jarred, or both. Under these conditions, the uppermost rail suspended round 25a has slid forwardly off of the rails 54, 60 (from its rail-supported position illustrated in FIG. 16) down into the gap "g" between the front ends 54a of the rails 54, 60 and the front wall 46 of the ammunition box 10. Under these conditions and as illustrated in FIG. 17 the round 25a, which previously suspended rounds 1b–12b from the rails 54, 60, has dropped into the gap "g" and instead of being suspended by the rails is suspended from the round 24a. Thus, a front string of rounds 25a and 1b–11b hangs down from round 24a and bears against the front wall 46 of the ammunition box 30. In addition, the round 24b which was previously supported on the rails behind the round 25a (FIG. 16) has also slid forward along the rails and dropped into the gap "g". When this occurs, the string of rounds 23b–12b will intermesh with the front string of rounds 25a, and 1b–11b. The round 24b can be trapped between the front ends 54a of the rails and rounds such as rounds 24a, 25a of the front string of rounds. This condition can result in hang-up interference and entanglement of the ammunition. A comparison of the conditions of FIGS. 16 and 17 renders clear how the reaction of the restrainer roller 100 insures a free feeding action of the rounds in response to the operation of the breech mechanism of the gun (not shown).

FIG. 18 illustrates a condition that immediately follows that previously described in connection with FIG. 16. In FIG. 18 the round 24a has been pulled upwardly toward the gun breech and in the process round 24a had swivelled about round 25a (FIG. 16) camming back the retainer roller 100 thereby accommodating the condition of FIG. 18. In FIG. 18 the round 25a, previously suspended at the forward ends of the rails 54, 60 has been pulled off of the front ends 54a of those rails and is just above the gap "g". The retainer roller 100 has been urged to the left again and the engagement point x with the clip 64 that embraces round 24b is now forward of the vertical plane y—y through the axis of round 24b. The roller 100 can now resiliently restrain forward sliding motion of the round 24b and the rounds suspended thereby, such as round 23b, round 22b, etc., as previously described. Thus, the front string or rounds, namely, rounds 24a, 25a, 1b, 2b, etc., adjacent to front wall 46 of the ammunition box 30 is free to be pulled upwardly into the breech of the gun, as the latter fires.

FIG. 19 illustrates the condition where the terminal rounds of the complete load, namely, rounds 8i and 9i have been pulled clear of the restrainer roller 100 and are ready for descent upwardly into the breech of the gun. The last portion 66 of the final link, which also includes link portion 64 embracing the terminal round 9*i*, is still suspended on the rails 54, 60. However, the arm 104 and the retainer roller 100 is urged to its extreme left or counterclockwise position by the arm biasing spring 120 (FIG. 2). As illustrated in the diagram of FIG. 20 under the conditions of FIG. 19, the projection 134 of the shaft 102 for the restrainer roller 100 is now brought against the opposed face 132 of the stop 130. When a new load of ammunition is to be placed in the magazine M, the restrainer roller 100 will be grasped and pulled rearwardly over the conical end 150 of the spring loaded latch pin 140, as illustrated in dotted lines in FIG. 3. The loading procedure previously described can now be repeated.

Having completed the detailed description of the invention it can be seen how the restrainer system of the present invention resiliently restrains a forwardmost round, supported on generally horizontal round-suspending rails, in a manner whereby the forwardmost round, and any rounds suspended thereby, do not fall against an ascending string of rounds being fed directly to the gun. The resilient but releasable restraint provided by the present invention thus prevents entanglement, jamming and interference of free feed of rounds to the gun in a suspended loop ammunition box wherein the rounds are suspended from generally horizontal rails.

Having completed a detailed description of the invention, I claim as follows:

1. An ammunition magazine for suspended loop stowage of ammunition rounds connected by an articulated belt, said magazine comprising a relatively deep box having side walls and a front wall, generally horizontal, continuous side rails along an upper portion of said box side walls for slidably suspending the end rounds of each loop, and roller means for applying a resilient downward and rearward restraining force on a round supported on the forward end portions of said rails against forward sliding motion of said round along the rails until pulled upwardly and forwardly off said rails and away from said roller means.

2. An ammunition magazine for suspended loop stowage of ammunition rounds connected by an articulated belt and to be pulled into a gun, said magazine comprising a relatively deep box having side walls and a front wall, generally horizontal and continuous side rails along an upper portion of said box side walls for slidably suspending the uppermost rounds of each loop; the improvement comprising means defining a round restraining roller, and means mounting said roller means for resiliently applying a downward and rearward restraining force on a round supported on the forward end portions of said rails against forward sliding motion along the rails, means for advancing a leading string of rounds into the gun for camming said roller means rearwardly and upwardly for releasing the round previously restrained by the roller.

3. An ammunition magazine for suspended loop stowage of ammunition rounds connected by an articulated belt and to be pulled into a gun, said magazine comprising a relatively deep box having side walls and a front wall, generally horizontal and continuous side rails along an upper portion of said box side walls for slidably suspending the uppermost rounds of each loop; the improvement comprising means defining a round restraining roller, means mounting said roller means for resiliently applying a downward and rearward restraining force on a round supported on the forward end portion of said rails against forward sliding motion along the rails, means for advancing a leading string of rounds into the gun for camming said roller means rearwardly and upwardly for releasing the round previously restrained by the roller, and detent means for releasably holding said roller in a round clearing position against the force of said resilient mounting means during a magazine loading operation.

4. An ammunition magazine for suspended loop stowage of ammunition rounds connected by an articulated belt; said magazine being of the type comprising a relatively deep box having side walls and a front wall; generally horizontal, continuous side rails along an upper portion of said box side walls for slidably suspending the upper rounds of each loop; the forward ends of said rails being spaced from said forward box wall to provide a gap for a leading string of rounds being fed directly to a gun: the improvement comprising a round restraining roller; means for mounting said roller on said box; and means for resiliently urging said roller downwardly and rearwardly against an upper round disposed at the forward ends of said rails for resiliently pressing the upper round against the terminal portion of said rails for restraining sliding motion of the upper round into said gap under the force of gravity until said round is pulled forwardly into the gun.

* * * * *